US007573425B2

(12) United States Patent
Chang et al.

(10) Patent No.: US 7,573,425 B2
(45) Date of Patent: Aug. 11, 2009

(54) ANTENNA FOR RADIO FREQUENCY IDENTIFICATION RFID TAGS

(75) Inventors: Chih-Chen Chang, Taipei County (TW); Yung-Chin Lo, Changhua County (TW)

(73) Assignee: Industrial Technology Research Institute, Hsinchu (TW)

( * ) Notice: Subject to any disclaimer, the term of this patent is extended or adjusted under 35 U.S.C. 154(b) by 192 days.

(21) Appl. No.: 11/688,819

(22) Filed: Mar. 20, 2007

(65) Prior Publication Data

US 2008/0231455 A1 Sep. 25, 2008

(51) Int. Cl.
*H01Q 1/38* (2006.01)

(52) U.S. Cl. ..... 343/700 MS; 343/793; 343/895

(58) Field of Classification Search ..... None
See application file for complete search history.

(56) References Cited

U.S. PATENT DOCUMENTS

2002/0149521 A1* 10/2002 Hendler et al. ..... 343/700 MS
2007/0008228 A1 1/2007 Yamada

FOREIGN PATENT DOCUMENTS

DE 10 2006001005 7/2007

OTHER PUBLICATIONS

Office Action dated Jan. 8, 2008, German Patent Application No. 10 2007 021 534.9-55, filed May 8, 2007.

* cited by examiner

*Primary Examiner*—Trinh V Dinh
(74) *Attorney, Agent, or Firm*—Alston & Bird, LLP

(57) ABSTRACT

An antenna configured for a radio frequency identification (RFID) device, the antenna comprising a first conductive element over a substrate, the first conductive element extending between a first end and a second end, and a second conductive element over the substrate, the second conductive element including a first path extending between a third end and a fourth end, a second path extending from the third end to a fifth end, and a third path extending from the third end to a sixth end, wherein the first end of the first conductive element is separated from but near one of the fifth end of the second path and the sixth end of the third path of the second conductive element.

17 Claims, 6 Drawing Sheets

ANTENNA FOR RADIO FREQUENCY IDENTIFICATION RFID TAGS

BACKGROUND OF THE INVENTION

The present invention generally relates to radio frequency identification (RFID) and, more particularly, to an antenna configured for an RFID tag.

Radio frequency identification (RFID) is an important technology in the identification industry and has various applications. RFID tags or labels are widely used to associate an object with an identification code. For example, RFID tags have been used for access control to buildings, security-locks in vehicles and tracking inventory. Information stored on an RFID tag may identify a person seeking access to a secured building or an inventory item having a unique identification number. RFID tags can retain and transmit enough information to uniquely identify individuals, packages, inventory and the like. Generally, in an RFID system, in order to retrieve the information from an RFID tag, an RFID reader may send an excitation signal to the RFID tag using radio frequency (RF) backscatter technology. The excitation signal energizes the tag, which in turn backscatters the stored information to the reader. The reader then receives and decodes the information from the RFID tag.

An RFID tag may generally include a chip for data processing and an antenna for data communication. In the RFID industry, it may be important for an RFID tag to efficiently receive or use the energy received from an RFID reader so as to facilitate a subsequent response to the reader or increase an available radio range over which the tag can communicate with the reader in a wireless manner. The efficiency may be improved by impedance matching between the chip and antenna of an RFID tag. Since the chip generally exhibits relatively high capacitive impedance, the antenna may be designed with relatively high inductive impedance to achieve conjugate match. Such high inductive impedance, however, may adversely narrow down the bandwidth of the RFID tag. Furthermore, the material of a substrate that carries an RFID tag may cause variation in the desired inductive impedance of the tag. Also, the capacitive impedance of the chip may vary due to semiconductor manufacturing processes. It may therefore be desirable to have an RFID tag antenna that is able to form complex conjugation with a corresponding chip. It may also be desirable to increase the bandwidth of an RFID tag while achieving complex conjugation for impedance match between the tag antenna and the chip.

BRIEF SUMMARY OF THE INVENTION

Examples of the present invention may provide an antenna configured for a radio frequency identification (RFID) device, the antenna comprising a first conductive element over a substrate, the first conductive element extending between a first end and a second end, and a second conductive element over the substrate, the second conductive element including a first path extending between a third end and a fourth end, a second path extending from the third end to a fifth end, and a third path extending from the third end to a sixth end, wherein the first end of the first conductive element is separated from but near one of the fifth end of the second path and the sixth end of the third path of the second conductive element.

Examples of the present invention may provide an antenna configured for a radio frequency identification (RFID) device, the antenna comprising a first conductive path over a substrate, the first conductive path including a length of one quarter-wavelength long and extending between a first end and a second end, a second conductive path over the substrate, the second conductive path extending between a third end and a fourth end, and a third conductive path over the substrate, the third conductive path including a length of one quarter-wavelength long and extending between the third end and a fifth end, wherein the first end of the first conductive element is separated from but near the fifth end of the third conductive path.

Examples of the present invention may provide an antenna configured for a radio frequency identification (RFID) device, the antenna comprising a first conductive element over a substrate, the first conductive element extending between a first end and a second end, and a second conductive element over the substrate, the second conductive element including a first path extending between a third end and a fourth end, and a second path extending from the third end to a fifth end, wherein the first end of the first conductive element is separated from but near the fifth end of the second path of the second conductive element by a gap, the gap being capable of determining a bandwidth of the antenna.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings examples which are presently preferred. It should be understood, however, that the invention is not limited to the precise arrangements and instrumentalities shown.

In the drawings.

DETAILED DESCRIPTION OF THE INVENTION

Reference will now be made in detail to the present examples of the invention illustrated in the accompanying drawings. Wherever possible, the same reference numbers will be used throughout the drawings to refer to the same or like portions.

Figure 1A:
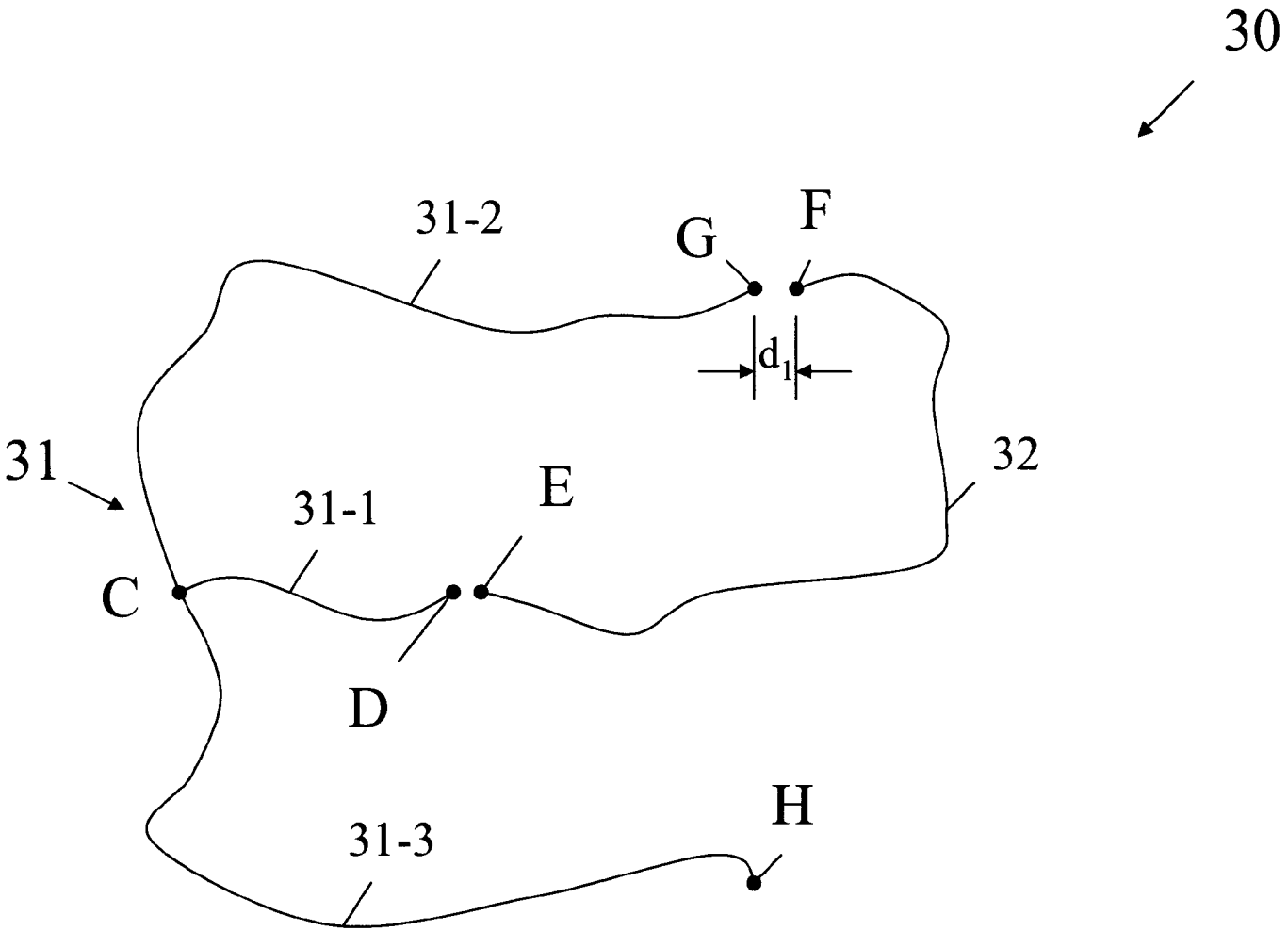
FIG. 1A is a schematic diagram of a radio frequency identification (RFID) tag consistent with an example of the present invention.

FIG. 1A is a schematic diagram of a radio frequency identification (RFID) tag 10 consistent with an example of the present invention. Referring to FIG. 1A, the RFID tag 10 may include a chip 11 and an antenna 12. The chip 11 may be coupled or secured to a substrate 13 and is electrically connected to the antenna 12 on or over the substrate 13. The chip 11 may include suitable electrical components such as, for example, resistors, capacitors, inductors, batteries, memory devices and processors for providing suitable interaction with an RFID reader through the antenna 12. In general, the chip 11 may exhibit a relatively high capacitive impedance ($Z_C$), which may be provided by chip manufactures and can be expressed as follows.

$$Z_C=R_C-jX_C$$

Where $R_C$, the real number of $Z_C$, represents a resistance of the chip 11, and $X_C$, the imaginary number of $Z_C$, represents a capacitive reactance of the chip 11.

The substrate 13 may form the basis for a personal identification badge, a label, a package container and the like. Suitable materials for the substrate 13 may include but are not limited to hard materials such as glass, epoxy, ceramic, Teflon and FR4, or organic materials such as paper, synthetic paper, plastic and polyimide. The resonance frequency of the antenna 12 may vary as the material, electrical characteristics and thickness of the substrate 13 vary.

The antenna 12 may include inductive materials such as, for example, copper, copper alloy, aluminum and inductive ink. An antenna pattern of the inductive material may be formed on or over the substrate 13 through etching, deposition or printing processes or other processes. In general, the antenna 12 may exhibit a relatively high inductive impedance ($Z_L$), which can be expressed as follows.

$$Z_L=R_L+jX_L$$

Where $R_L$, the real number of $Z_L$, represents a radiation resistance of the antenna 12, and $X_L$, the imaginary number of $Z_L$, represents an inductive reactance of the antenna 12. In designing the antenna 12, it may be desirable to form complex conjugation for $Z_C$ and $Z_L$ while improving the bandwidth of the antenna 12.

Referring back to FIG. 1A, the antenna 12 may include two or more sub sets, such as a first antenna element 12-1 and a second antenna element 12-2. The first antenna element 12-1 may include a first conductive path (referred to as "the first path CD" hereinafter) extending between nodes "C" and "D, a second conductive path (referred to as "the second path CAG" hereinafter) extending from node "C" to node "A" and then to node "G", and a third conductive path (referred to as "the third path CBH" hereinafter) extending from node "C" to node "B" and then to node "H". The first path CD may have a length $W_4$, which is configured to achieve a desired inductance reactance value, i.e., $X_L$. In one example of the present invention, the value of $X_L$ increases as the length $W_4$ increases. Furthermore, at least a portion of the second path CAG, for example, the path CA, and at least a portion of the third path CBH, for example, the path CB, may form a path ACB having a length $H_1$, which is configured to achieve a desired radiation resistance value, i.e., $R_L$. In one example of the present invention, the value of $R_L$ increases as the length $H_1$ increases.

Each of the second path CAG, the third path CBH and the second antenna element 12-2 is a quarter-wavelength transmission path, whose length is one quarter wavelength long, or an odd multiple of one quarter wavelength long. In one example, the RFID tag 10 may accept one or more of various frequencies, such as at least one of three frequency bands. An example of those three frequency bands may include a microwave band at or near 2.45 gigahertz (GHz)), an ultra high frequency (UHF) band in the range of 860 megahertz (MHz) to 960 MHz, and a high frequency (HF) band at or near 13.65 MHz. In other examples, the RFID tag 10 may accept another or other combination of frequency bands depending on its applications. The antenna 12 may be configured to obtain sufficient antenna gain to transceive electric waves in a desired waveband. Using a frequency of 915 MHz in the UHF band as an example, each of the second path CAG, the third path CBH and the second antenna element 12-2 may have a length of approximately 32 centimeters ($=3\times10^8$ m/915 M).

The second antenna element 12-2 may include a first end "E" and a second end "F", which may function to serve respectively as a shorting point and a feeding point of the RFID antenna 12. The first end "E" of the second antenna element 12-2 may be electrically connected to a pin or pad (not shown) of the chip 11, while one end "D" of the first path CD may be electrically connected to another pin or pad (not shown) of the chip 11. Furthermore, the second end "F" of the second antenna element 12-2 may be separated from but near one end "G" of the second path CAG. The distance between the ends F and G is $d_1$, which may affect the coupling of electrical fields and in turn the bandwidth of the antenna 12. In one example of the present invention, the amount of electrical coupling decreases as the distance $d_1$ increases. A desired bandwidth may be obtained by changing the amount of electrical coupling. The first antenna element 12-1 may be characterized as being "open-circuit" coupled to the second antenna element 12-2. Specifically, the second antenna element 12-2 is "open-circuit" coupled to the second path CAG at the end "G". In another example, the second antenna element 12-2 may be open-circuit coupled to the third path CBH at the end "H".

Figure 1B:
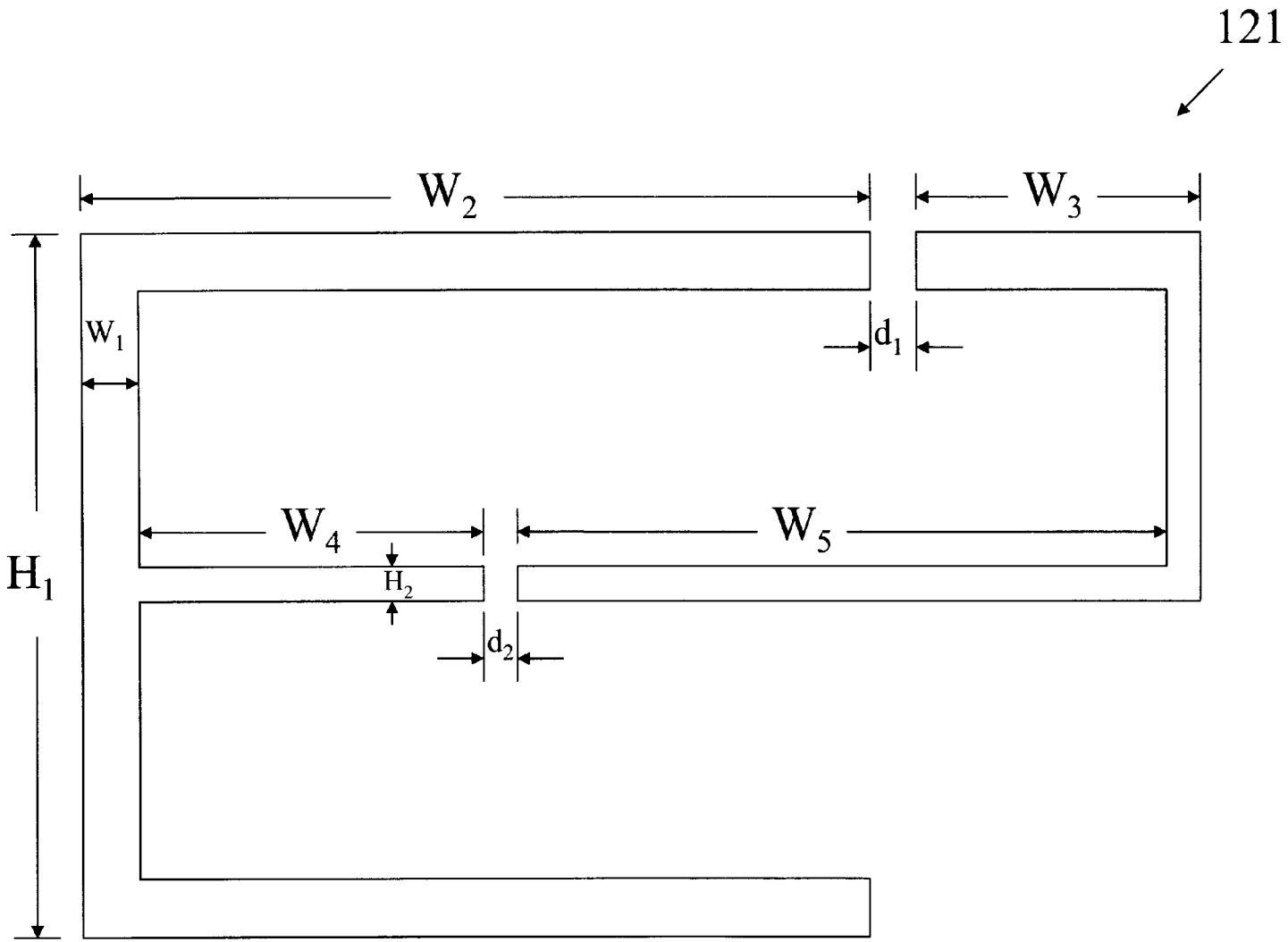
FIG. 1B is a schematic diagram of an antenna configured for the RFID tag illustrated in FIG. 1A consistent with an example of the present invention.

Skilled persons in the art will understand that the antenna 12 may be designed with various antenna patterns while achieving the desired electrical characteristics such as the desired impedance of the RFID tag 10. FIG. 1B is a schematic diagram of an antenna 121 configured for the RFID tag 10 illustrated in FIG. 1A consistent with an example of the present invention. Referring to FIG. 1B, the antenna 121 may be formed on or over a paper substrate and may accept a radiation frequency of approximately 915 MHz in one example. And the lengths $H_1$ and $W_4$, which may respectively determine the radiation resistance and inductive reactance of the antenna 121, may respectively be approximately 44 millimeter (mm) and 25 mm. The open-circuit gap $d_1$, which may determine the amount of electrical coupling and in turn the bandwidth of the antenna 121, may be approximately 0.5 mm. Other parameters of the antenna 121 may also be set according to its applications. For example, a set of parameters may include lengths $W_1$ of approximately 2 mm, $W_2$ of approximately 58.5 mm, $W_3$ of approximately 10 mm, $W_5$ of approximately 40 mm and $H_2$ of approximately 1 mm. Furthermore, the gap $d_2$, which may depend on the pin gap of the chip 11, may be approximately 0.25 mm.

Figure 1C:
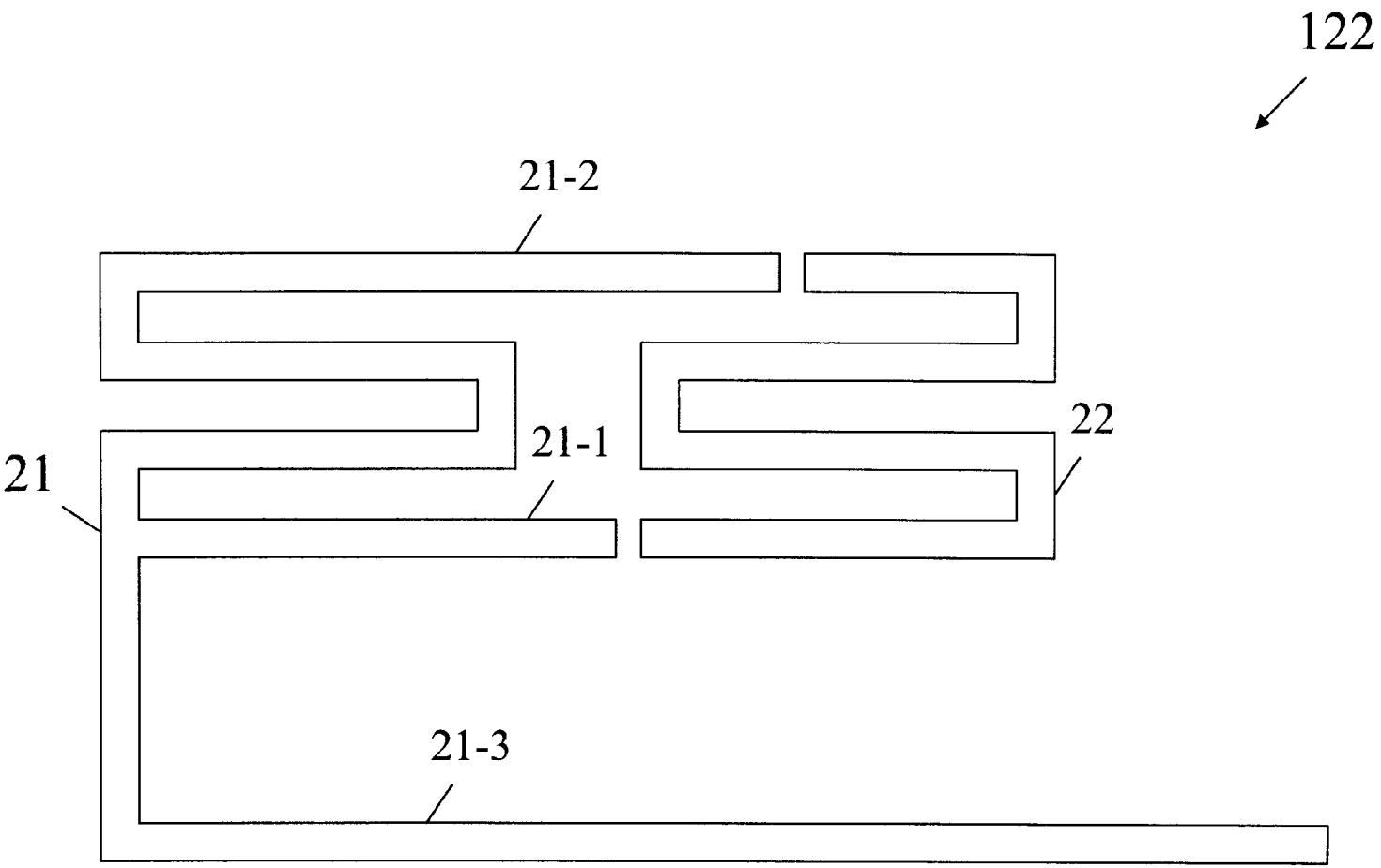
FIG. 1C is a schematic diagram of an antenna configured for the RFID tag illustrated in FIG. 1A consistent with another example of the present invention.

FIG. 1C is a schematic diagram of an antenna 122 configured for the RFID tag 10 illustrated in FIG. 1A consistent with another example of the present invention. Referring to FIG. 1C, the antenna 122 may include a first antenna element 21 and a second antenna element 22. The first antenna element 21 may further include a first path 21-1, a second path 21-2 and a third path 21-3. Each of the second path 21-2, the third path 21-3 and the second antenna element 22 may be one quarter-wavelength long. The second path 21-2 may include a meander or winding structure, such as the one illustrated in FIG. 1C, which may be one quarter wavelength long. Furthermore, the second antenna element 22 may employ a meander or winding structure, such as the one illustrated in FIG. 1C, which may be one quarter wavelength long.

The above-mentioned parameters for the antenna 121 illustrated in FIG. 1B and the antenna 122 illustrated in FIG. 1C may be determined based on simulation, such as with the help of a simulation software. In one example, HFSS™ by the Ansoft Corporation (Pittsburgh, United States) may be used. HFSS™ may support three-dimensional (3D) electromagnetic-field simulation for high performance electronic design. For example, the HFSS may support the electromagnetic simulation of high-frequency and high-speed components, and has been widely used for the design of antennas and RF and/or microwave components as well as on-chip embedded passives, printed circuit board (PCB) interconnects and high-frequency integrated-circuit (IC) packages.

Figure 1D:
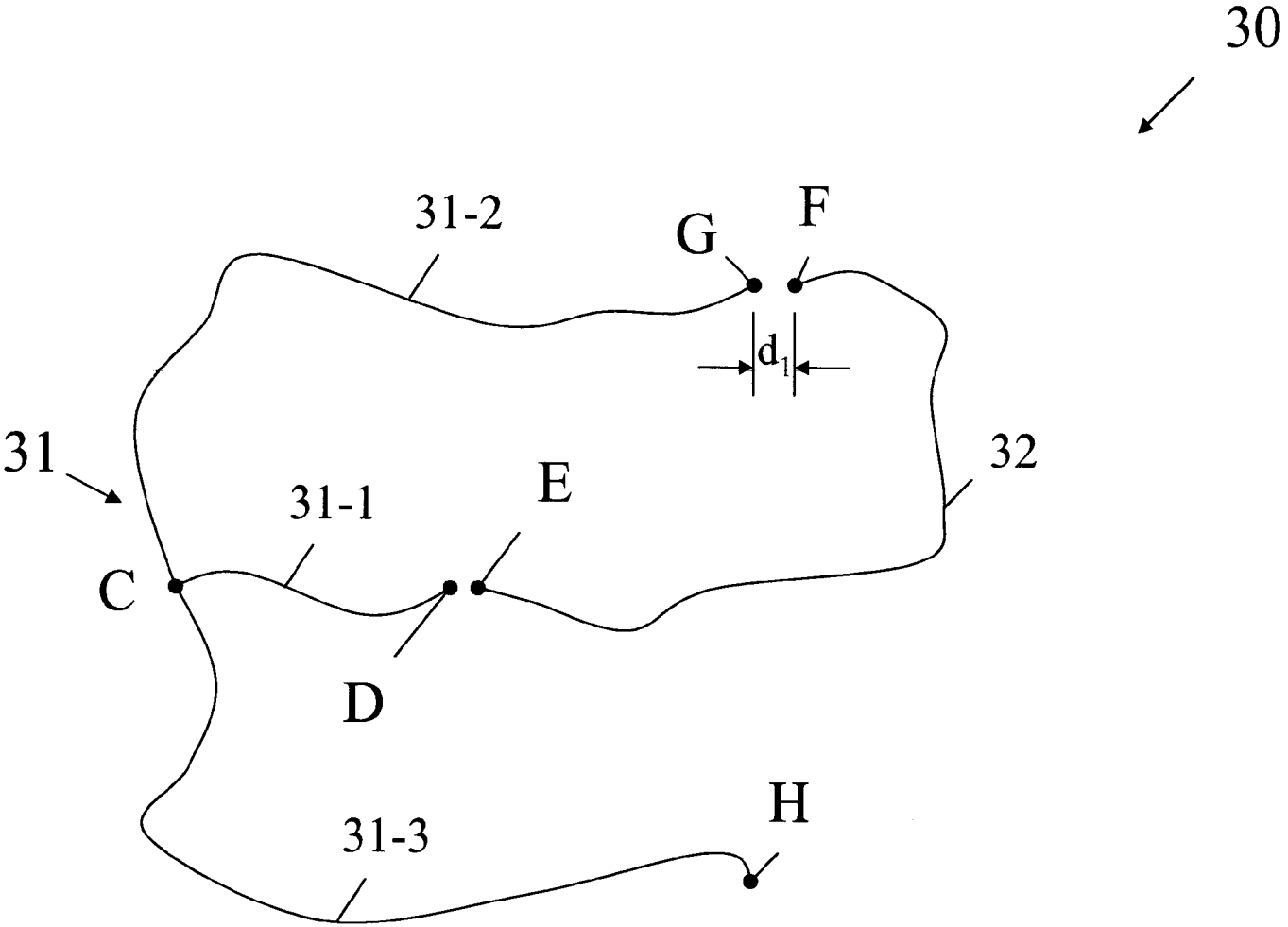
FIG. 1D is a schematic diagram of an antenna configured for an RFID tag consistent with another example of the present invention.

FIG. 1D is a schematic diagram of an antenna 30 configured for an RFID tag consistent with another example of the present invention. Referring to FIG. 1D, the antenna 30 may include a first element 31 and a second element 32. The first element 31 may further include a first conductive path 31-1, a second conductive path 31-2 and a third conductive path 31-3. Each of the first, second and third conductive paths 31-1, 31-2 and 31-3 and the second element 31 may include a meander or winding structure. Furthermore, each of the second and third conductive paths 31-2 and 31-3 and the second element 32 may be one quarter wavelength long. With the help of a simulation software, the parameters associated with the antenna 30 may be determined.

Figure 2:
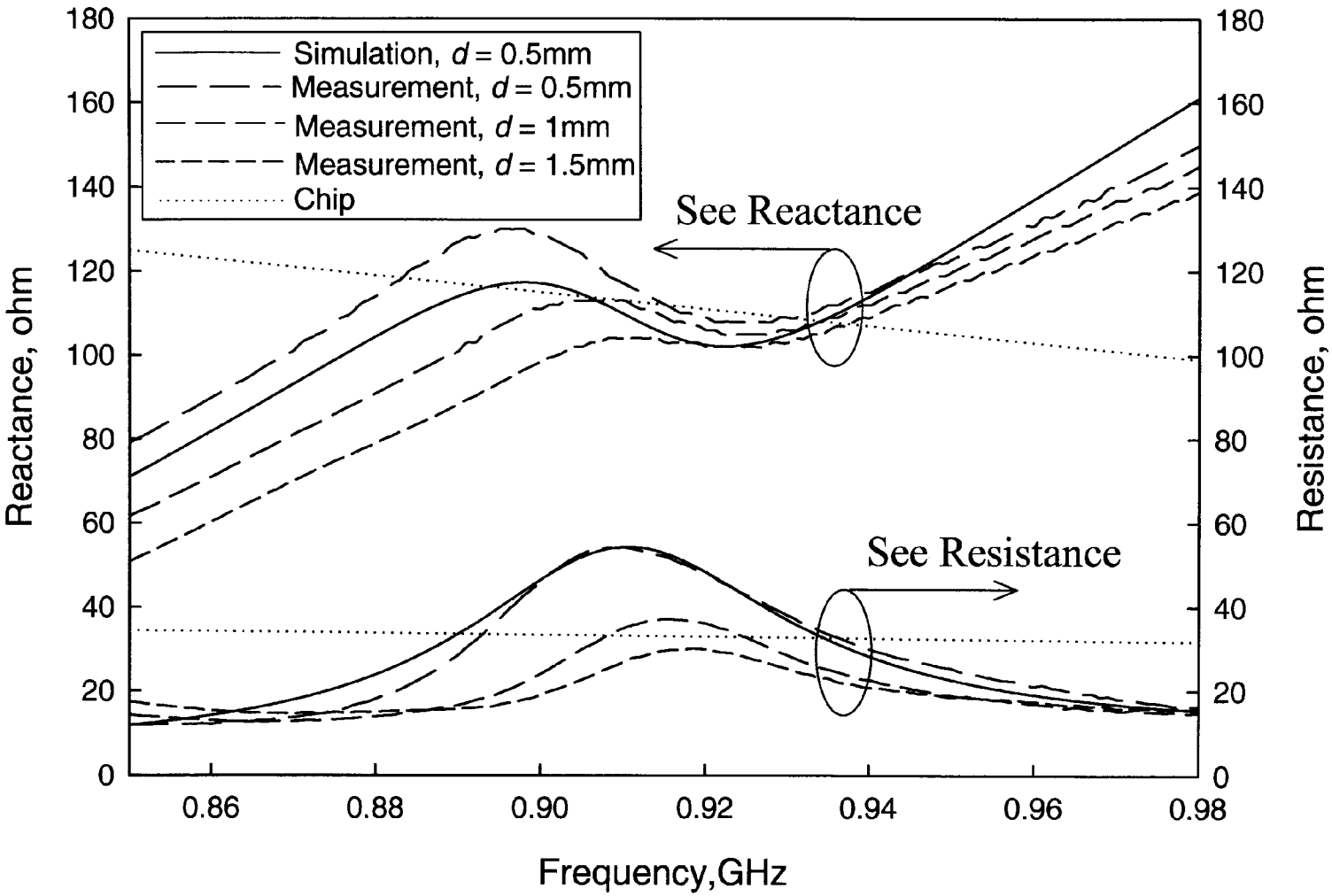
FIG. 2 shows exemplary plots illustrating the impedance of an antenna configured for an RFID tag at different open-circuit distances.

FIG. 2 shows exemplary plots illustrating the impedance of an antenna configured for an RFID tag at different open-circuit distances. The plots may be provided by a simulation software product such as the HFSS. The antenna may include a similar antenna pattern and associated parameters to the antenna 121 illustrated in FIG. 1B. Referring to FIG. 2, the capacitive reactance of the chip decreases as the frequency increases, while the resistance of the chip may remain at a constant independent of the frequency. The resistance and inductive reactance of the antenna may vary as the frequency varies at different gaps, i.e., 0.5 mm, 1.0 mm and 1.5 mm. Conjugate matching in impedance between the chip and the antenna at each of the different gaps may therefore be determined.

Figure 3:
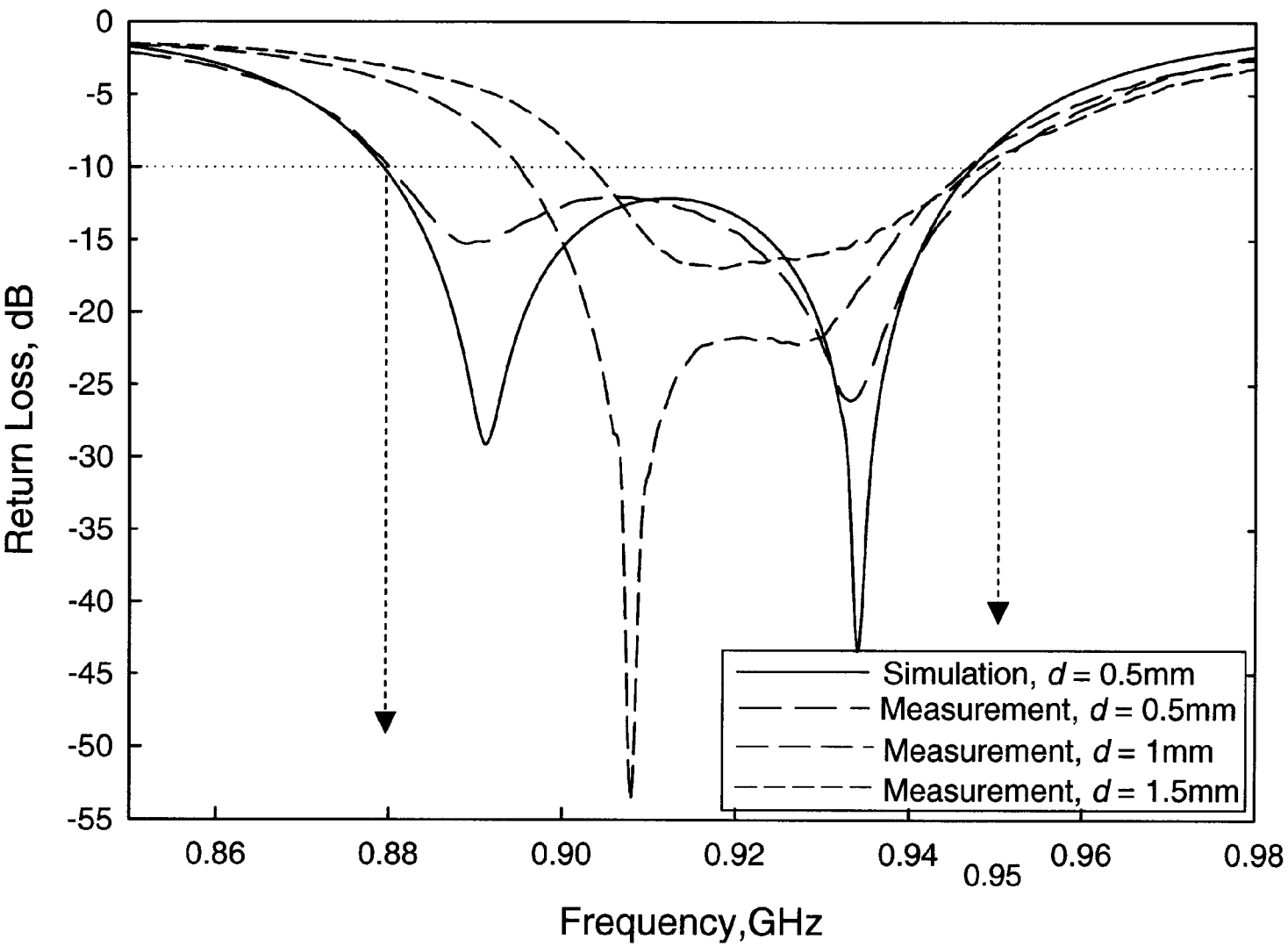
FIG. 3 shows exemplary plots illustrating the return loss of an antenna configured for an RFID tag at different open-circuit distances.

FIG. 3 shows exemplary plots illustrating the return loss of an antenna configured for an RFID tag at different open-circuit distances. The plots may be provided by a simulation software product such as the HFSS. The antenna may include a similar antenna pattern and associated parameters to the antenna 121 illustrated in FIG. 1B. Referring to FIG. 3, when a return loss greater than 10 dB is concerned, the antenna has a relatively wide bandwidth greater than approximately 70 MHz in the front and rear parts of a center frequency 910 MHz.

In describing representative examples of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

It will be appreciated by those skilled in the art that changes could be made to the examples described above without departing from the broad inventive concept thereof. It is understood, therefore, that this invention is not limited to the particular examples disclosed, but it is intended to cover modifications within the spirit and scope of the present invention as defined by the appended claims.

We claim:

1. An antenna configured for a radio frequency identification (RFID) device, the antenna comprising:

a first conductive element over a substrate, the first conductive element extending between a first end and a second end;

a second conductive element over the substrate, the second conductive element including a first path extending between a third end and a fourth end, a second path extending from the third end to a fifth end, and a third path extending from the third end to a sixth end, wherein the first conductive element comprises at least one bend extending from the second end to the first end toward the fifth end so that the first end of the first conductive element is separated from but near one of the fifth end of the second path or the sixth end of the third path of the second conductive element, wherein the first end of the first conductive element is separated from the fifth end of the second path of the second conductive element by a gap, and wherein a bandwidth of the antenna is a function of a length of the gap;

wherein the second end of the first conductive element is electrically connected to a first pin of a chip, and the fourth end of the first path of the second conductive element is electrically connected to a second pin of the chip.

2. The antenna of claim 1, wherein each of the first conductive element and the second path and the third path of the second conductive element is approximately one quarter-wavelength long.

3. The antenna of claim 1, wherein a portion of the second path extending from the third end and a portion of the third path extending from the third end form a length capable of determining a resistance of the antenna.

4. The antenna of claim 1, wherein the first path of the second conductive element includes a length capable of determining an inductive reactance of the antenna.

5. The antenna of claim 1, wherein the first end of the first conductive element is separated from the sixth end of the third path of the second conductive element by the gap, and wherein a coupling amount of the antenna is also a function of the length of the gap.

6. The antenna of claim 1, wherein the first conductive element includes a meander structure.

7. The antenna of claim 1, wherein at least one of the first path, the second path or the third path of the second conductive element includes a meander structure.

8. An antenna configured for a radio frequency identification (RFID) device, the antenna comprising:

a first conductive path over a substrate, the first conductive path including a length of approximately one quarter-wavelength long and extending between a first end and a second end;

a second conductive path over the substrate, the second conductive path extending between a third end and a fourth end;

a third conductive path formed on the substrate, the third conductive path including a length of approximately one quarter-wavelength long and extending between the third end and a fifth end, wherein the first conductive element comprises at least one bend extending from the second end to the first end toward the fifth end so that the first end of the first conductive path is separated from but near the fifth end of the third conductive path; and a fourth conductive path over the substrate, the fourth conductive path including a length of approximately one quarter-wavelength long and extending between the third end and a sixth end;

wherein the first end of the first conductive path is separated from the sixth end of the fourth conductive path by a gap, and a bandwidth of the antenna is a function of a length of the gap; and wherein the second end is electrically connected to a first pin of a chip, and the fourth end is electrically connected to a second pin of the chip.

9. The antenna of claim 8, wherein a portion of the third path extending from the third end and a portion of the fourth path extending from the third end form a length capable of determining a resistance of the antenna.

10. The antenna of claim 8, wherein the second conductive path includes a length capable of determining an inductive reactance of the antenna.

11. The antenna of claim 8, wherein the first end of the first conductive path is separated from the fifth end of the third conductive path by a gap, and wherein a coupling amount or a bandwidth of the antenna is a function of a length of the gap.

12. The antenna of claim 8, wherein at least one of the first conductive path, the second conductive path or the third conductive path includes a meander structure.

13. An antenna configured for a radio frequency identification (RFID) device, the antenna comprising:

a first conductive element over a substrate, the first conductive element extending between a first end and a second end;

a second conductive element over the substrate, the second conductive element including a first path extending between a third end and a fourth end, and a second path extending from the third end to a fifth end, and a third path extending from the third end to a sixth end, wherein the first conductive element comprises at least one bend extending from the second end to the first end toward the fifth end so that the first end of the first conductive element is separated from but near the fifth end of the second path of the second conductive element, wherein the first end of the first conductive path is separated from the fifth end of the second path of the second conductive element by a gap, and a bandwidth of the antenna is a function of a length of the gap; and wherein the second end is electrically connected to a first pin of a chip, and the fourth end is electrically connected to a second pin of the chip.

14. The antenna of claim 13, wherein each of the first conductive element and the second path of the second conductive element includes a length of approximately one quarter-wavelength long.

15. The antenna of claim 14, wherein a portion of the second path extending from the third end and a portion of the third path extending from the third end form a length capable of determining a resistance of the antenna.

16. The antenna of claim 13, wherein the first path of the second conductive element includes a length capable of determining an inductive reactance of the antenna.

17. The antenna of claim 13, wherein a coupling amount of the antenna is also a function of the length of the gap.

* * * * *